United States Patent [19]

Thornley

[11] 4,156,217

[45] May 22, 1979

[54] ELECTROMAGNETICALLY OPERABLE SWITCH

[75] Inventor: Derek Thornley, Lancashire, England

[73] Assignee: Lucas Industries Limited, Birmingham, England

[21] Appl. No.: 835,360

[22] Filed: Sep. 21, 1977

[30] Foreign Application Priority Data

Oct. 5, 1976 [GB] United Kingdom ..... 41227/76

[51] Int. Cl.[2] ..... H01H 67/02

[52] U.S. Cl. ..... 335/107; 335/122; 335/190

[58] Field of Search ..... 335/106, 107, 121, 122, 335/190

[56] References Cited

U.S. PATENT DOCUMENTS

| | | | |
|---|---|---|---|
| 3,036,174 | 5/1962 | Ardia et al. | 335/122 X |
| 3,808,387 | 4/1974 | Harris | 335/190 X |

FOREIGN PATENT DOCUMENTS

| | | | |
|---|---|---|---|
| 2082894 | 10/1971 | France | 337/107 |

*Primary Examiner*—George Harris

*Attorney, Agent, or Firm*—Holman & Stern

[57] ABSTRACT

An electrical switch having first and second sets of contacts and an operating member which is associated with both sets of contacts such that both sets of contacts can be moved from one of their operative states to the other operative state by a single movement of the operating member. A first electromagnetic arrangement is provided whereby the first set of contacts can be returned from the closed state to the open state by the application to the first electromagnetic arrangement of an electrical signal, and there is a second electromagnetic arrangement whereby the second set of contacts can be returned from the closed state to the open state by the application to the second electromagnetic arrangement of the electrical signal. The switch is so arranged that the first set of electrical contacts is returned by the electrical signal to its open state in advance of the return of the second set of electrical contacts to its open state.

12 Claims, 7 Drawing Figures

ELECTROMAGNETICALLY OPERABLE SWITCH

This invention relates to an electrical switch.

A switch according to the invention includes a first set of electrical contacts having open and closed operative states, a second set of electrical contacts having open and closed operative states, an operating member associated with both said first and second sets of contacts such that said first and second contacts can be moved from one of their operative states to the other operative state by a single movement of the operating member, first electromagnetic means whereby the first set of contacts can be returned from said other operative state to said one operative state by the application to said first electromagnetic means of an electrical signal, and, second electromagnetic means whereby said second set of contacts can be returned from said other operative state to said one operative state by the application to said second electromagnetic means of said electrical signal, the arrangement being such that said first set of electrical contacts is returned by said electrical signal from said other operative state to said one operative state in advance of the return of said second set of contacts from said other operative state to said one operative state.

Preferably said switch has associated therewith a signal delay means whereby said electrical signal is applied to said second electromagnetic means at a point in time after its application to said first electromagnetic means to achieve the return of the second set of contacts after the return of the first set of contacts.

Alternatively, said electrical signal is applied simultaneously to said first and second electromagnetic means and said first and second sets of contacts are mechanically dissimilar such that the second set of contacts is returned to said one operative state after the return of said first set of contacts to said one operative state.

Preferably, said switch includes electrical signal delay means whereby said electrical signal is applied to said second electromagnet means after its application to said first electromagnetic means and in addition said first and second sets of electrical contacts are mechanically dis-similar so as to aid said delay means in ensuring return movement of said first set of contacts to said one operative state in advance of return movement of the second set of contacts to said one operative state.

Desirably, the first and second sets of contacts are mechanically dis-similar in that the moving components of the first set of contacts have a lower inertia than the moving components of the second set of contacts and thus are moved more rapidly than the movable components of the second set of contacts.

Preferably, said first set of contacts includes a first fixed contact, a second contact movable by said first electromagnetic means, and an electrically conductive bridging member movable with said operating member, said first fixed contact being engaged with the movable bridging member and said second contact being engageable with said bridging member in response to movement of said operating member while said first electomagnetic means is inoperative, said second contact being movable out of engagement with said bridging member by operation of said first electromagnetic means.

Preferably, the second set of contacts includes a fixed contact, and a movable contact, the movable contact being movable into and out of engagement with said fixed contact by movement of said operating member, and being also movable either into, or alternatively out of, engagement with said fixed contact by operation of said second electromagnetic means.

Desirably, said operating member is rotatable, and said bridging member of said first set of contacts is an arcuate conductive strip and said first fixed contact and said second contact are wiping contacts engageable respectively with the strip.

Conveniently, said operating member is rotatable and said movable contact of said second set of contacts is movable relative to the fixed contact of the second set of contacts by rotation of the operating member through the intermediary of a cam carried by the operating member, said movable contact being resiliently biassed in one direction relative to said fixed contact and being movable against said resilient bias by rotation of the cam, said cam being movable axially by said second electomagnetic means to permit movement of the movable contacts under the action of said resilient means.

Conveniently, said cam carries first and second cam forms each of which is capable, upon rotation of the cam, of moving said movable contact into engagement with said fixed contact, said second cam form commencing on said cam adjacent the termination of said first cam form and the co-operation of the cam and the movable contact being such that after movement of the movable contact against said resilient bias by the first cam form, and subsequent return movement of said movable contact under its resilient bias as a result of axial movement of the cam, the movable contact cooperates with the second cam form of the cam so that the movable contact can again be moved against its resilient bias by further rotation, in the same direction, of the operating member and the cam.

Preferably, said movable contact of said second set of contacts is resiliently supported on said contact carrier and is movable by said cam through the intermediary of said contact carrier, the switch further including a slide member carried by a housing of the switch and movable relative thereto, and a lever pivoted on the housing, the lever coupling the slide member and the contact carrier whereby the slide member is moved relative to the housing by movement of the contact carrier relative to the housing, the position of the slide member relative to the housing providing an indication of the open or closed condition of the fixed and movable contacts of the second set of contacts and there being a degree of lost motion in the coupling between the slide and the contact carrier such that the slide is only moved to indicate the contacts closed operative state during movement of the contact carrier relative to the movable contact to apply contact pressure after the movable contact has engaged the fixed contact.

Conveniently the slide member and the housing are so arranged that in one position of the slide member a region of the slide member is obscured by the housing and in the second position of the slide member a region of the housing is obscured by the slide member, said regions of the slide member and the housing carrying respective indicia one of which is indicative of the contacts open operative state and the other of which is indicative of the contacts closed operative state, the slide member being in a position wherein the contacts open indicium is visible and the contacts closed indicium is obscured when the movable contact is spaced from the fixed contact, and being in a position where the contacts open indicium is obscured, and the contacts closed indicium is visible when the movable contact is engaged with the fixed contact.

One example of the invention is illustrated in the accompanying drawings wherein.

Figure 1:
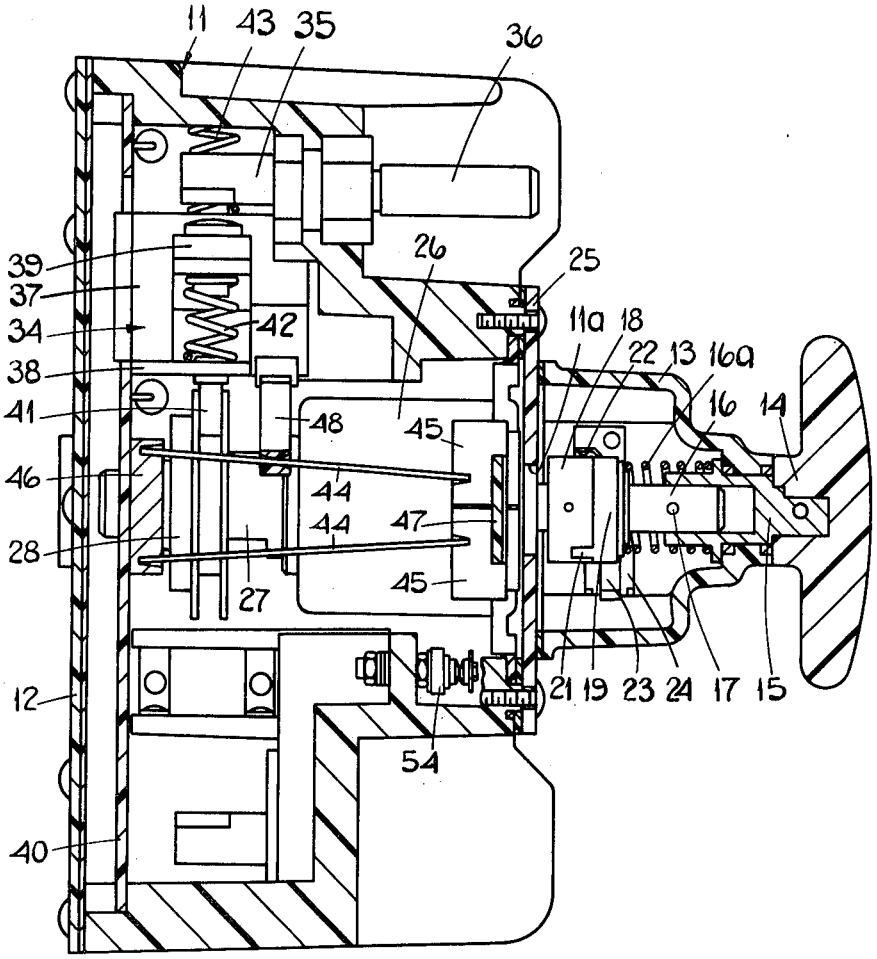
FIG. 1 is a composite sectional view of an electrical switch for use primarily as a battery master switch for a road vehicle, parts of the construction being omitted from FIG. 1 for clarity.

Referring to the drawings, the electrical switch is intended as a battery master switch for use in a road vehicle. A battery master switch is intended to provide control primarily over the electrical connections which are made to the battery, and is capable of isolating the vehicle battery from the remainder of the vehicle electrical circuit. In addition to containing heavy duty contacts whereby connections are made directly to the battery the switch also includes further sets of contacts controlling auxiliary circuits.

The switch includes a moulded synthetic resin housing 11 closed at one end by a metal panel 12.

The housing 11 is sealed and at its end remote from the panel 12 carries a boss 13 having an operating handle 14 journalled for rotation therein. The handle 14 includes a hollow spigot 15 within which is slidably received a spindle 16. A transversely extending pin 17 carried by the spindle 16 engages elongate slots in the spigot 15 to rotatably couple the spigot 15 and the spindle 16.

Mounted on the spindle 16 for rotation therewith is an electrically insulating drum 18 carrying a conductive band 19. The conductive band 19 extends circumferentially of the drum and includes an axially extending extension 21. The boss 13 carries internally a contact assembly comprising a pair of wiping contacts 22 is disposed axially of the drum so as to be able to engage the extension 21 in one predetermined angular position of the drum relative to the boss 13. The other of the contacts 23 is disposed axially of the drum so as to engage the continuous band 19 and thus will make electrical contact therewith irrespective of the angular position of the drum. However the contact 23 is carried by the movable armature of an electromagnetic relay 24 which, when energised lifts the contact 23 out of engagement with the band 19. Thus in an angular position of the drum 18 where the contact 22 engages the extension 21 then the contacts 22, 23 are electrically interconnected by the band 19 provided that the electromagnetic relay is not energised.

Figure 5:
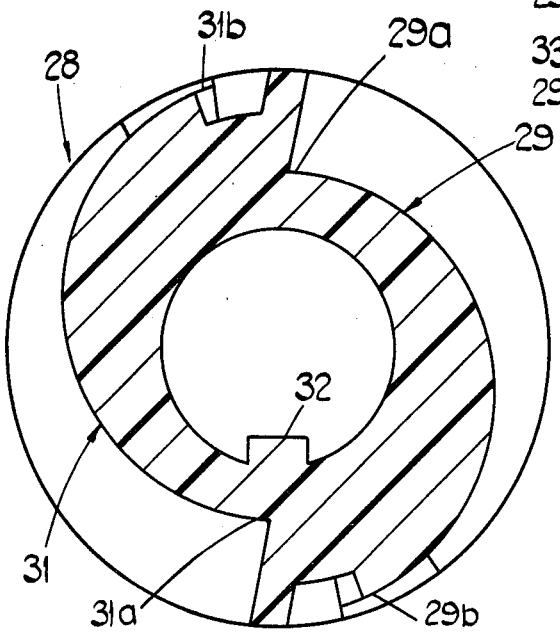
FIG. 5 is a sectional view on the line 5—5 in FIG. 4.
Figure 6:
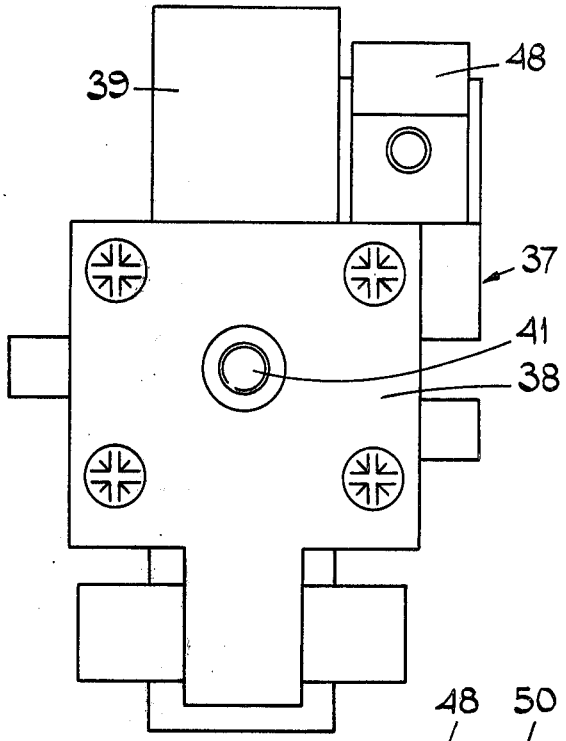
FIG. 6 is a plan view of a moving contact assembly of the switch as shown in FIG. 1.
Figure 7:
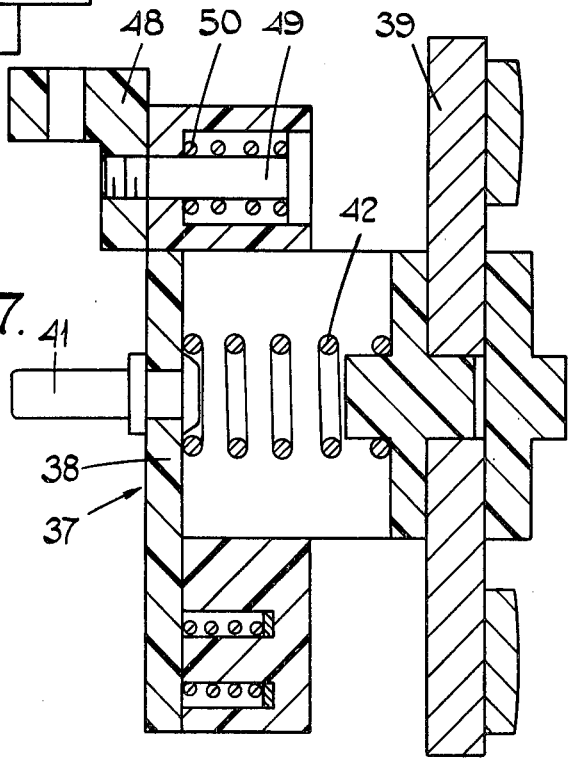
FIG. 7 is a composite sectional view of the assembly shown in FIG. 6.

The spindle 16 extends through a partition wall 25 separating the interior of the boss 13 from the interior of the housing 11. The spindle 16 is ferromagnetic, and extends co-axially within a solenoid winding 26 disposed within the housing 11. A ferromagnetic plunger 27 also extends co-axially into the solenoid winding 26 and is coupled to the spindle 16 for axial movement therewith relative to the solenoid winding 26. Energisation of the solenoid winding 26 thus results in axial movement of the plunger 27 and the spindle 16 relative to the solenoid winding 26 and the housing 11. A spring **16*a* acts between the spigot 15 and the drum 18 to urge the spindle 16 and plunger 27 towards a rest position as shown in FIG. 1. Thus rotation of the handle 14 rotates the spindle 16 and the plunger 27 relative to the housing. Secured to the plunger 27 is a moulded synthetic resin cam 28, the cam 28 having a pair of circumferentially extending cam forms 29, 31. With the exception of a single internal key 32 the cam 28 is symmetrical about a diameter thereof. Each of the cam forms 29, 31** extends through approximately 160° of the circumference of the cam and each of the cam forms spirals outwardly from a low point indicated by the suffix *a* to a high point indicated by the suffix *b* (FIG. 5). The two cam forms 29, 31 are co-planar, and are disposed towards one axial end of the cam 28. Each of the cam forms is defined by the base of a channel and thus is bounded on either side by a side wall The high end **31*b* of the cam form 31 terminates circumferentially adjacent the low end of the cam form 31. At the high end of the cam form 31 the innermost side wall is cut away and the side walls are inclined, the cam form terminating in a radial step 31*c*. A plateau 31*d* is defined below the step 31*c* and is bounded in a circumferential direction by a radial axially extending wall 31*e*. A further radial step 31*f* descends from the plateau 31*d* to a plateau 32 which is at the height of the low end 29*a* of the cam form 29. An axially extending channel 33 co-planar with the plateau 32 and the low end 29*a* of the cam form 29 interconnects the plateau 32 and the commencement of the cam form 29 interconnects the plateau 32 and the commencement of the cam form 29. A similar sequence of steps walls and plateaux is defined between the high end of the cam form 29 and the commencement of the cam form 31. The cam 28 is mounted on the plunger 27 with its axial end region carrying the cam forms closest to the solenoid winding 26**.

Within the housing 11, diametrically opposite one another and on opposite sides of the plunger 27 are first and second battery contact assemblies 34 the majority of the second contact assemblies being omitted from FIG. 1 for clarity.

Each contact assembly 34 includes a pair of copper contact posts 35 which are secured to the housing 11 by having the housing 11 moulded therearound during manufacture of the housing. Each of the contact posts 35 includes an integral screw threaded terminal pillar 36 accessible at the exterior of the housing 11. Additionally, each contact arrangement 34 includes a moving contact assembly 37 comprising a moulded synthetic resin contact carrier 38, and a copper bridging plate 39.

Each contact carrier 38 is mounted for sliding movement in the housing in a direction radially of the cam 28 and each contact carrier 38 carries a cam follower 41 which engages a respective cam form of the cam 28. The bridging contact 39 of each assembly 37 is resiliently mounted on its carrier 38 and is urged by a compression spring 42 to a limit position at a maximum spacing from the carrier 38. In addition, a further compression spring 43 acts between each moving contact assembly and the housing to urge the assembly radially towards the cam 28. The moving contact assemblies are disposed between the fixed contacts 35 and the cam and in operation rotation of the cam causes the cam followers 41 to ride up their respective cam forms so that the moving contact assemblies are moved radially outwardly to engage their bridging contacts 39 with the fixed contacts 35 to complete electrical circuits between their respective fixed contacts 35. The throw of each of the cam forms is greater than the maximum spacing between the bridging contacts and their respective fixed contacts, so that not only are the bridging contacts engaged with their fixed contacts during rotation of the cam but additionally the contact carriers are moved further compressing the springs 42 to apply contact pressure to the contacting faces of the bridging contacts 39 and their fixed contacts 35.

Although only one of the contact arrangements 34 is shown in FIG. 1 it is to be understood that both contact arrangements operate simultaneously and identically, the only point of difference being that while one of the content arrangements is being operated by the cam form 29, the other will be operated simultaneously by the cam form 31.

In operation, assuming that the cam followers 41 are engaged at the low points of their respective cam forms then the bridging contacts 39 will be spaced from their fixed contacts 35 and the main battery connections will thus be in an open-circuit condition with the battery isolated. Rotation of the handle 14 through 160° rotates the cam 28 through 160° that is to say rotates the cam 28 through the angular extent of the cam forms 29, 31. During this rotation movement the contact assemblies 37 are moved sufficiently far firstly to engage their bridging contacts 39 with the respective fixed contacts 35 to complete the battery circuits through the fixed contacts 35, and thereafter after the move the contact carriers relative to the bridging contacts to apply the contact pressure by way of the spring 42. Thus after 160° rotation the followers 41 are at the high ends of their respective cam forms. It will be noted that at the high end of each of the cam forms the side walls are inclined towards the end of the cam 28 remote from the solenoid. The last few degrees of rotation of the cam form thus causes the cam 28, the plunger 27 and the spindle 16 to be moved axially against the action of the spring **16*a* and at the 160° point the cam followers 41 ride over the step 31*c* and the equivalent step on the cam form 29. The drop of the step is insufficient to release the movable contacts 39 from the fixed contacts 35 and the height of the plateau 31*d* and the equivalent plateau 29*d* is sufficient to maintain the correct contact pressure. It will be noted also that the step 31*c* and the equivalent step 29*c* are inclined, and in the contacts closed position reverse rotation of the handle 14 thus, by virtue of co-operation between the inclined steps 31*c*, 29*c* and the cam followers 41 causes further axial movement of the cam 28 plunger 27 and spindle 16 against the action of the spring 16*a*. The plateaux 31*d*, 29*d* extend circumferentially around the cam at a constant height to terminate ultimately in steps 31*g*, 29*g* which drop to the plateaux 32. Thus reverse rotation of the handle 14 from the contacts closed position causes the cam followers to ride on the plateaux 29*d*, 31*d* maintaining the contacts closed throughout virtually the whole of the return movement, until the cam followers drop over the steps 29*g*, 31*g* and onto the plateaux 32. Thereafter of course the cam followers are aligned with the passages 33 so that the cam 28, the plunger 27 and the spindle 16 can be returned under the action of the spring 16*a* in an axial direction to re-engage the cam followers 41 with the commencement of their respective cam forms 29, 31**.

It will be appreciated that reverse rotation of the handle 14 may prove too slow to effect open circuit of the battery in an emergency situation. Furthermore, the switch may be remote from the driver of the vehicle so that the handle 14 is not conveniently accessible. For this reason a push button switch is provided adjacent the driver location and connected to the solenoid winding 26. Closure of the push button switch energises the solenoid winding 26 in the closed condition of the main battery contacts and thus causes instantaneous movement of the spindle 16, the plunger 27 and the cam 28 against the action of the spring **16*a*. It will be understood at this point in time the cam followers are engaged on the plateaux 29*d*, 31*d* adjacent the high ends of their respective cam forms and so the axial movement of the cam 28 will cause the cam followers 41 to drop over the shoulders 31*f*, 29*f* to immediately engage the plateaux 32 permitting the movable contact assemblies to return to their rest positions under the action of the springs 43 opening the main battery contacts. Return of the contacts de-energises the solenoid but the cam cannot return in the axial direction under the action of spring 16*a* until the cam has been rotated through a small angular distance to align the cam followers with the passage 33 so that the cam followers can engage once again with the commencement of the cam form 29**. It follows therefore that after emergency operation of the switch to open circuit the battery by means of the push button, the contacts can then be re-closed merely by further rotation of the handle in the first mentioned direction, that is to say without reverse rotation.

Within the housing adjacent the panel 12 is a printed circuit board 40 and supported by the printed circuit board inwardly of the housing is a moulded synthetic resin shoe 46. The shoe 46 is pivotally engaged by a pair of levers 44 which extend towards the boss 13 and have their ends opposite the shoe 46 received in respective slide blocks 45, slidable relative to the housing. Intermediate their ends each of the levers 44 is coupled to the contact carrier 38 of a respective contact arrangement 34. The slide blocks 45 when abutting one another include regions visible through a window **11*a* of the housing, said regions of the slide blocks carrying the legend OFF. In this position of the slide blocks the slide blocks obscure a legend plate 47 of the housing which carries the legend ON. The slide blocks 45 can be moved away from one another by means of the levers 44 so that the legend on the plate 47** is visible through the window of the housing and the two parts of the legend carried by the slide blocks are obscured by the housing.

The coupling between each of the levers 44 and its respective contact carrier 38 is a lost motion coupling comprising a link 48 pivotally connected to the lever intermediate its ends and being connected to the contact carrier 38 by means of a headed pin 49. The headed pin 49 extends through the contact carrier 38 and is urged into abutment with one face of the contact carrier 38 by means of a light spring 50 acting between the head of the pin 49 and the contact carrier. The spacing between the head of the pin and the mutually presented face of the carrier 38 is equal to the spacing between the bridging contact 39 and the fixed contacts 35 of the contact arrangement 34 in the rest position of the moving contact assembly. Thus during operation of the moving contact assemblies the bridging members 39 engage their respective contacts 35 at the same time that the lost motion between the carriers 38 and the links 48 is absorbed. Thereafter, the further movement of the contact carrier, relative to its bridging contact to apply the contact pressure is transmitted to the link 48 and through the link 48 to the respective lever 44. The positioning along the length of each lever 44 of the link 48 is so chosen that the degree of movement of the contact carrier 38 to apply contact pressure moves the appropriate slide block 45 sufficiently far for its legend to be obscured and the legend on the plate 47 to be revealed. Similarly during return movement of the contact carrier, the contact carrier initially moves relative to the link 48 to re-establish the full extent of the lost motion connection, and thereafter the link 48 is moved with the contact carrier thus moving the lever and the appropriate slide block 45 back to its original position. It will be appreciated that since the contact arrangements 34 move along in opposite directions to achieve their operative positions, then the slide blocks 45 are moved away from one another during this movement. The light spring 50 in the lost motion coupling moves its respective slide block rapidly and restores said lost motion once the block has started to move towards its ON position. However, it is to be understood that the force exerted by the spring 50 is not sufficient to overcome the inherent resistance to movement of the slide blocks and so the slide blocks are not moved to reveal the ON legend until the lost motion has been absorbed that is to say until the contacts 35 have actually been engaged by their respective bridging members.

As mentioned above, the contacts 35 and their associated bridging members 39 control the direct connections to the battery. The previously mentioned contacts 19, 22, 23 serve in use to control the flow of current to the field winding of the alternator of the vehicle. The extension 21 of the contact band 19 is so arranged that the alternator field circuit is completed shortly after the bridging contacts 39 engage their fixed contacts 35 so that is to say after 160° rotation of the handle 14. However it is important that the alternator field contacts are opened prior to the opening of the main contacts irrespective of whether or not the main contacts are opened manually or electrically, by means of the solenoid 26. It will be recalled that during reverse rotation of the handle 14 the co-operation of the cam followers 41 with the inclined radial steps 31*c* and 29*c* caused axial movement of the plunger 27 and the spindle 16. The drum 18 is carried by the spindle 16 and thus the drum 18 and contact band 19 are moved axially relative to the contact 22, 23. The degree of axial movement is sufficient to break the electrical connection between the contacts 22 and 23 by way of the band 19 and thus while the main contacts are held closed during the return rotation of the handle 14 by the cam followers 41 riding on the plateaux 29*d*, 31*d* by the cam field contacts are opened immediately the reverse rotation commences. The drum 18 of course moves axially back to its original position with the spindle 16 and the plunger 27 when the cam followers 41 engage the plateaux 32 but of course reverse rotation of the drum has also taken place and the extension 21 is thus angularly displaced by 160° from the contacts 22. Thus the return axial movement does not re-establish the connection between the contacts 22, 23.

In the event that the main contacts are opened electrically by energisation of the solenoid 26 then the connection between the contacts 22, 23 is still broken first by virtue of the contacts 23 being mounted on the armature of the relay 24. The relay 24 is also energised by operation of the emergency push button mentioned above. The mass of the moving parts of the relay is considerably less than the moving parts of the solenoid arrangement and thus the relay will operate to open the contacts 22, 23 in advance of the main contacts opening. In order to increase the delay between opening of the alternator field contacts and opening of the main contacts, the solenoid winding 26 is arranged to be energised, upon closure of the push button, through an electrical delay unit.

Figure 2:
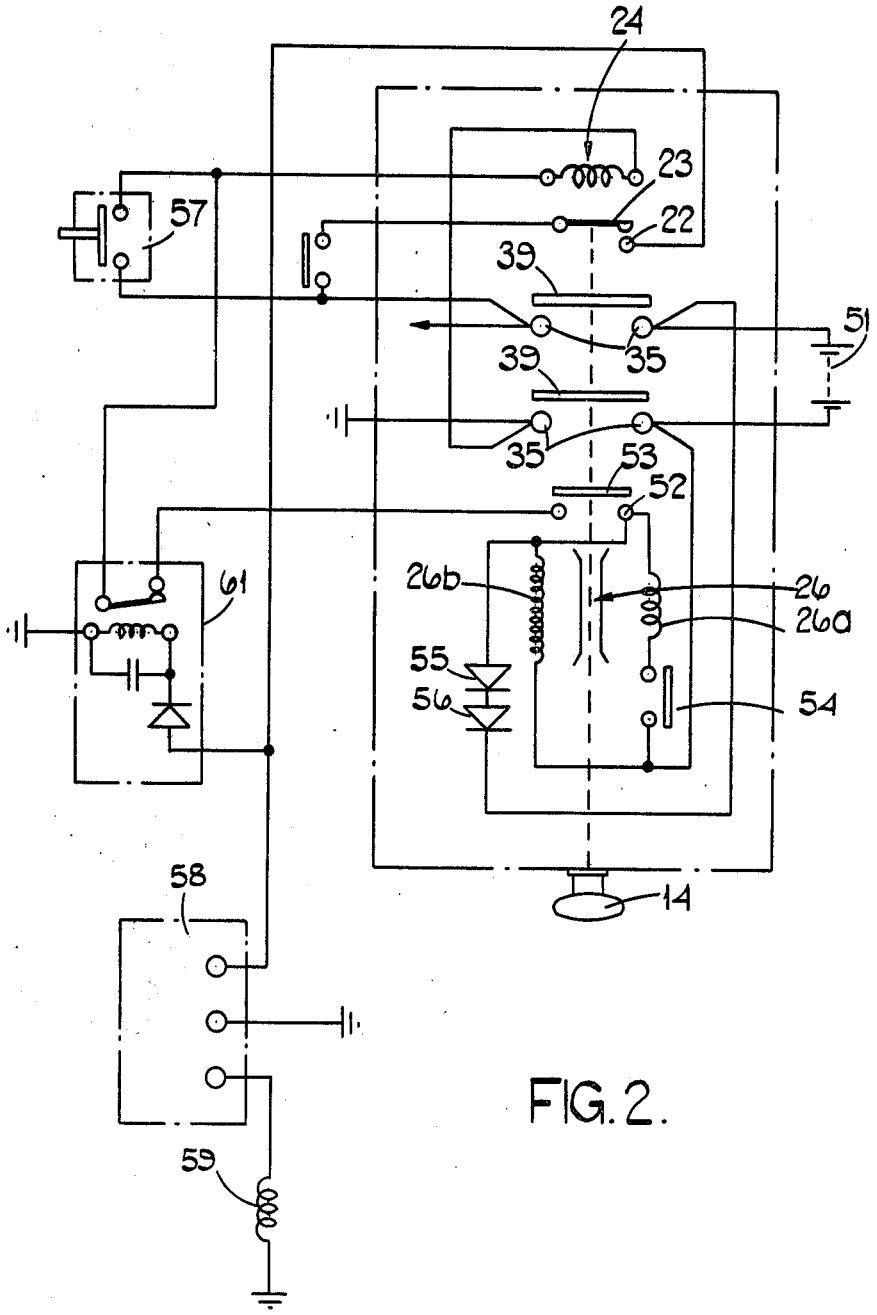
FIG. 2 is a circuit diagram illustrating the switch shown in FIG. 1 in use.
Figure 3:
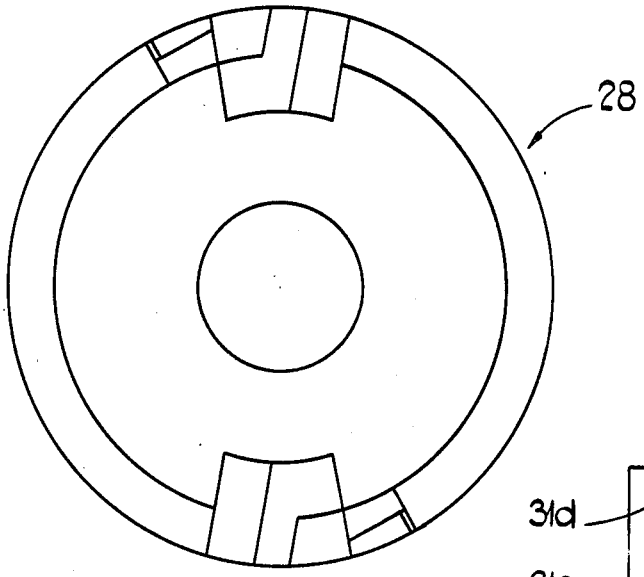
FIG. 3 is a plan view of a cam of the switch shown in FIG. 1.
Figure 4:
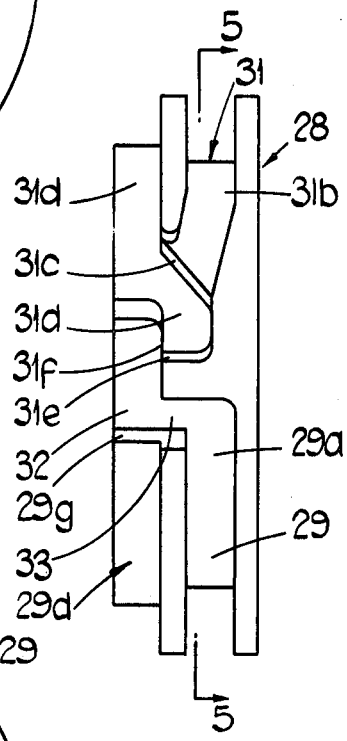
FIG. 4 is a side elevational view of the cam shown in FIG. 3.

FIG. 2 illustrates the electrical circuit of the switch and its association with other parts of the vehicle electrical circuit. The two pairs of fixed contacts 35 with their associated bridging members 39 constitute a double pole switch, one pair of contacts 35 controlling the positive line and the other pair of contacts controlling the negative line. Thus a positive input contact 35 is connected to the positive pole of the battery 51 while the negative input contact 35 is connected to the negative pole of the battery 51. The negative output contact 35 is connected to the vehicle earth and the positive output contact 35 is connected to the vehicle auxiliary circuits to supply, for example, the windscreen wipers, the lights, the direction indicator system and the like of the vehicle. A further pair of contacts 52 not seen in the other drawings are bridged by a bridging member 53 at the same point that the bridging members 39 bridge the respective contacts 35. The bridging member 53 is in fact carried by one of the contact carriers 38 in exactly the same manner as its bridging member 39. The solenoid winding 26 consists of a pull in coil 26*a* and a hold on coil 26*b*. One end of the pull in coil is connected to one of the contacts 52 while the other end is connected through a thermal cut-out switch 54 to the negative input contact 35. A diode 55 has its anode connected to said one end of the coil 26*b* and its cathode connected to the anode of a second diode 56. The cathode of the second diode 56 is connected to the positive input contact 35 and thus when the battery 51 is correctly connected to the input contacts no current flows in the coils 26*a*, 26*b* provided that the contacts 52 are open. In the event that the battery 51 is wrongly connected however, that is to say with its negative pole connected to the positive input terminal and its positive pole connected to the negative input terminal then the diodes 55, 56 conduct energising the solenoid 26 to move the cam 28 so that the contact assembly 34 cannot be operated by rotation of the handle. Thus the switch cannot be closed with the battery wrongly connected.

The positive output terminal is connected through the aforementioned push button switch 57 and the winding of the relay 24 in series to the negative output contact 35. Thus assuming that the contacts 35 are bridged by the members 39 then closure of the switch 57 energises the relay winding to move the contact 23 away from the drum. Since in the operative condition where the contacts 35 are bridged the contacts 23 will be connected to the contacts 22 through the band 19 then closure of the switch 57 disconnects the contact 23 from the contacts 22. The contact 22 is connected through the voltage regulator 58 of the vehicle and the field winding 59 of the alternator of the vehicle to earth. It will be recalled that operation of the push button 57 must not only open the alternator field contacts, but must also energise the solenoid 26. Thus a connection is taken from the negative side of the switch 57 through a delay unit 61 to the other of said contacts 52. Since the contacts 52 are bridged by the member 53 in the closed position of the main battery contacts then in fact the connection is through the delay unit and the two coils of the solenoid to the negative input contact.

The delay unit 61 includes a pair of normally closed relay contacts in series with the contacts 52 and an operating winding having one end connected to earth. The other end of the operating winding is connected to the cathode of a diode the anode of which is connected to the contact 22 of the alternator field winding contacts. A capacitor bridges the operating winding, and thus while the contact 23 engages the contact 22 the operating winding of the delay unit 61 will be energised and the relay contacts thereof will be held open. However, when the push button 57 is depressed the contacts 23, 22 are immediately opened and the supply through the diode to the operating winding of the delay unit is broken. However the normally closed contacts are not immediately permitted to return to their closed condition since the capacitor discharges through the operating winding holding the relay contacts open for a predetermined length of time, conveniently a quarter of a second. Thereafter, the normally closed contacts close and the solenoid coils are energised from the positive output terminal through the switch 57, the normally closed contacts of the delay unit and the contacts 52.

When the coils **26*a*, 26*b* are maintained energised for any significant length of time, the thermal cut-out 54 in series with the pull in coil 26*a* will operate to open circuit the pull in coil so that only the hold on coil 26*b* remains energised. The force generated by the hold on coil is of course sufficient to hold the plunger 27 and spindle 16 in their axially moved position. The thermal cut-out 54 is re-set automatically when its temperature drops below a predetermined value. The ignition switch of the vehicle is connected between the alternator field contact 23 and the positive output terminal 35** and thus the alternator field cannot be energised until the ignition switch is closed.

I claim:

1. An electrical switch including a first set of electrical contacts having open and closed operative states, a second set of electrical contacts having open and closed operative states an operating member associated with both of said first and second sets of contacts such that said first and second contacts can be moved from one of their operative states to the other operative state by a single movement of the operating member, first electromagnetic means whereby the first set of contacts can be returned from said other operative state to said one operative state by the application to said first electromagnetic means of an electrical signal, and, second electromagnetic means whereby said second set of contacts can be returned from said other operative state to said one operative state by the application to said second electromagnetic means of said electrical signal, the arrangement being such that said first set of electrical contacts is returned by said electrical signal from said other operative state to said one operative state in advance of the return of said second set of contacts from said other operative state to said one operative state.

2. A switch as claimed in claim 1 having associated therewith a signal delay means whereby said electrical signal is applied to said second electromagnetic means at a point in time after its application to said first electromagnetic means to achieve the return of the second set of contacts after the return of the first set of contacts.

3. A switch as claimed in claim 1 wherein said electrical signal is applied simultaneously to said first and second electromagnetic means and said first and second sets of contacts are mechanically dis-similar such that the second set of contacts is returned to said one operative state after the return of said first set of contacts to said one operative state.

4. A switch as claimed in claim 1 including electrical signal delay means whereby said electrical signal is applied to said second electromagnetic means after its application to said first electromagnetic means and in addition said first and second sets of electrical contacts are mechanically dis-similar so as to aid said delay means in ensuring return movement of said first set of contacts to said one operative state in advance of return movement of the second set of contacts to said one operative state.

5. A switch as claimed in claim 3 wherein the first and second sets of contacts are mechanically dis-similar in that the moving components of the first set of contacts have a lower inertia than the moving components of the second set of contacts and thus are moved rapidly than the movable components of the second set of contacts.

6. A switch as claimed in claim 3 wherein said first set of contacts includes a first fixed contact a second contact movable by said first electromagnetic means, and an electrically conductive bridging member movable with said operating member, said first fixed contact being engaged with the movable bridging member and said second contact being engageable with said bridging member in response to movement of said operating member while said first electromagnetic means is inoperative, said second contact being movable out of engagement with said bridging member by operation of said first electromagnetic means.

7. A switch as claimed in claim 3 wherein said second set of contacts includes a fixed contact and a movable contact the movable contact being movable into and out of engagement with said fixed contact by movement of said operating member, and being also movable either into, or alternatively out of engagement with said fixed contact by operation of said second electromagnetic means.

8. A switch as claimed in claim 3 wherein said operating member is rotatable and said bridging member of said first set of contacts is an arcuate conductive strip and said first fixed contact and said second contact are wiping contacts engageable respectively with the strip.

9. A switch as claimed in claim 7 wherein said operating member is rotatable and said movable contact of said second set of contacts is movable relative to the fixed contact of the second set of contacts by rotation of the operating member through the intermediary of a cam carried by the operating member, said movable contact being resiliently biassed in one direction relative to said fixed contact and being movable against said resilient bias by rotation of the cam, said cam being movable axially by said second electromagnetic means to permit movement of the movable contact under the action of said resilient bias.

10. A switch as claimed in claim 9 wherein said cam carries first and second cam forms each of which is capable, upon rotation of the cam, of moving said movable contact into engagement with said fixed contact, said second cam form commencing on said cam adjacent the termination of said first cam form and the cooperation of the cam and the movable contact being such that after movement of the movable contact against said resilient bias by the first cam form, and subsequent return movement of said movable contact under its resilient bias as a result of axial movement of the cam, the movable contact co-operates with the second cam form of the cam so that the movable contact can again be moved against its resilient bias by further rotation in the same direction, of the operating member and the cam.

11. A switch as claimed in claim 9 wherein said movable contact of said second set of contacts is resiliently supported on a contact carrier and is movable by said cam through the intermediary of said contact carrier, the switch further including a slide member carried by a housing of the switch and movable relative thereto, and a lever pivotted on the housing, the lever coupling the slide member and the contact carrier whereby the slide member is moved relative to the housing by movement of the contact carrier relative to the housing, the position of the slide member relative to the housing providing an indication of the open or closed condition of the fixed and movable contacts of the second set of contacts and there being a degree of lost motion in the coupling between the slide and the contact carrier such that the slide is only moved to indicate the contacts closed operative state during movement of the contact carrier relative to the movable contact to apply contact pressure after the movable contact has engaged the fixed contact.

12. A switch as claimed in claim 11 wherein the slide member and the housing are so arranged that in one position of the slide member a region of the slide member is obscured by the housing and in the second position of the slide member a region of the housing is obscured by the slide member, said regions of the slide member and the housing carrying respective indicia one of which is indcative of the contacts open operative state and the other of which is indicative of the contacts closed operative state, the slide member being in a position wherein the contacts open indicium is visible and the contacts closed indicium is obscured when the movable contact is spaced from the fixed contact, and being in a position where the contacts open indicium is obscured, and the contacts closed incidium is visible when the movable contact is engaged with the fixed contact.

* * * * *